US006188007B1

(12) United States Patent
Liao

(10) Patent No.: US 6,188,007 B1
(45) Date of Patent: Feb. 13, 2001

(54) FOLDING COLLAPSIBLE FOOT PEDAL MECHANISM FOR A HI-HAT CYMBAL

(76) Inventor: Tsun-Chi Liao, No. 14, Chun-Kung Rd., Taichung City (TW)

( * ) Notice: Under 35 U.S.C. 154(b), the term of this patent shall be extended for 0 days.

(21) Appl. No.: 09/516,222

(22) Filed: Mar. 1, 2000

(51) Int. Cl.[7] ..... G10D 13/02
(52) U.S. Cl. ..... 84/422.3; 84/422.1; 84/422.2
(58) Field of Search ..... 84/422.3, 422.1, 84/422.2

(56) References Cited

U.S. PATENT DOCUMENTS 3,464,305 * 9/1969 Meazzi et al. ..... 84/422.3

* cited by examiner

*Primary Examiner*—Robert E. Nappi
*Assistant Examiner*—Shih-yung Hsieh
(74) *Attorney, Agent, or Firm*—Bacon & Thomas, PLLC

(57) ABSTRACT

A folding collapsible foot pedal mechanism installed in a hi-hat cymbal, the foot pedal mechanism including a pedal holder assembly, a foot pedal fixedly fastened to the pedal holder assembly, and a linking mechanism coupled between the foot pedal and the bottom end of the center rod in the center shaft of the hi-hat cymbal, wherein the pedal holder assembly includes a U-shaped holder base, the holder base having two parallel posts; a transverse rod connected between the posts; two clamping plates respectively fastened to the posts to fix the transverse rod in position; and an angled coupling head turned about the transverse rod, the coupling head having a transverse through hole, which receives the transverse rod, and a vertical through hole, which receives the center shaft of the hi-hat cymbal.

3 Claims, 7 Drawing Sheets

FOLDING COLLAPSIBLE FOOT PEDAL MECHANISM FOR A HI-HAT CYMBAL

BACKGROUND OF THE INVENTION

The present invention relates to a hi-hat cymbal, and more a folding collapsible foot pedal mechanism for a hi-hat cymbal.

A regular hi-hat cymbal, as shown in FIG. 1, is generally comprised of a stand, a center shaft supported on the stand and holding a lower cymbal, a center rod mounted in the center shaft and holding an upper cymbal, and a foot pedal mechanism coupled to the bottom end of the center rod. When the foot pedal of the foot pedal mechanism is pressed down, the center rod is lowered, and the upper cymbal is moved to strike the lower cymbal. When the foot pedal is released, the center rod is immediately pushed upwards to its former position by spring means. This structure of hi-hat cymbal has drawbacks. Because the foot pedal is perpendicularly extended from a foot pedal holder assembly at the bottom side of the center shaft, it tends to be damaged during transportable of the hi-hat cymbal. Further, because the foot pedal mechanism is not collapsible, the hi-hat cymbal occupies much storage space when not in use. FIGS. 2 and 3 show another structure of hi-hat cymbal, in which the foot pedal can be folded up when not in use. However, the height of the hi-hat cymbal remains unchanged when the foot pedal is folded up, and much storage space is still needed to receive the collapsed hi-hat cymbal.

SUMMARY OF THE INVENTION

The present invention has been accomplished under the circumstances in view. According to one aspect of the present invention, the folding collapsible foot pedal mechanism is installed in a hi-hat cymbal comprised of a folding collapsible stand, a hollow shaft supported on the stand, a center rod mounted in the shaft, a stand control lock, an elevation control lock, and an upper cymbal control lock, the foot pedal mechanism comprising a pedal holder assembly, a foot pedal fixedly fastened to the pedal holder assembly, and a linking mechanism coupled between the foot pedal and a bottom end of the center rod. The pedal holder assembly comprises a U-shaped holder base, the holder base comprising two parallel posts; a transverse rod connected between the posts; two clamping plates respectively fastened to the posts to fix the transverse rod in position; and an angled coupling head turned about the transverse rod, the coupling head comprising a transverse through hole, which receives the transverse rod, and a vertical through hole, which receives said shaft. When not in use, the holder base and the foot pedal are turned with the coupling head about transverse rod, enabling the foot pedal to be moved from a horizontal position to a vertical position in parallel to the shaft of the hi-hat cymbal. According to another aspect of the present invention, two end stops are respectively fastened to two distal ends of the transverse rod to stop the transverse rod from axial movement relative to the posts.

DETAILED DESCRIPTION OF THE PREFERRED EMBODIMENT

Figure 1:
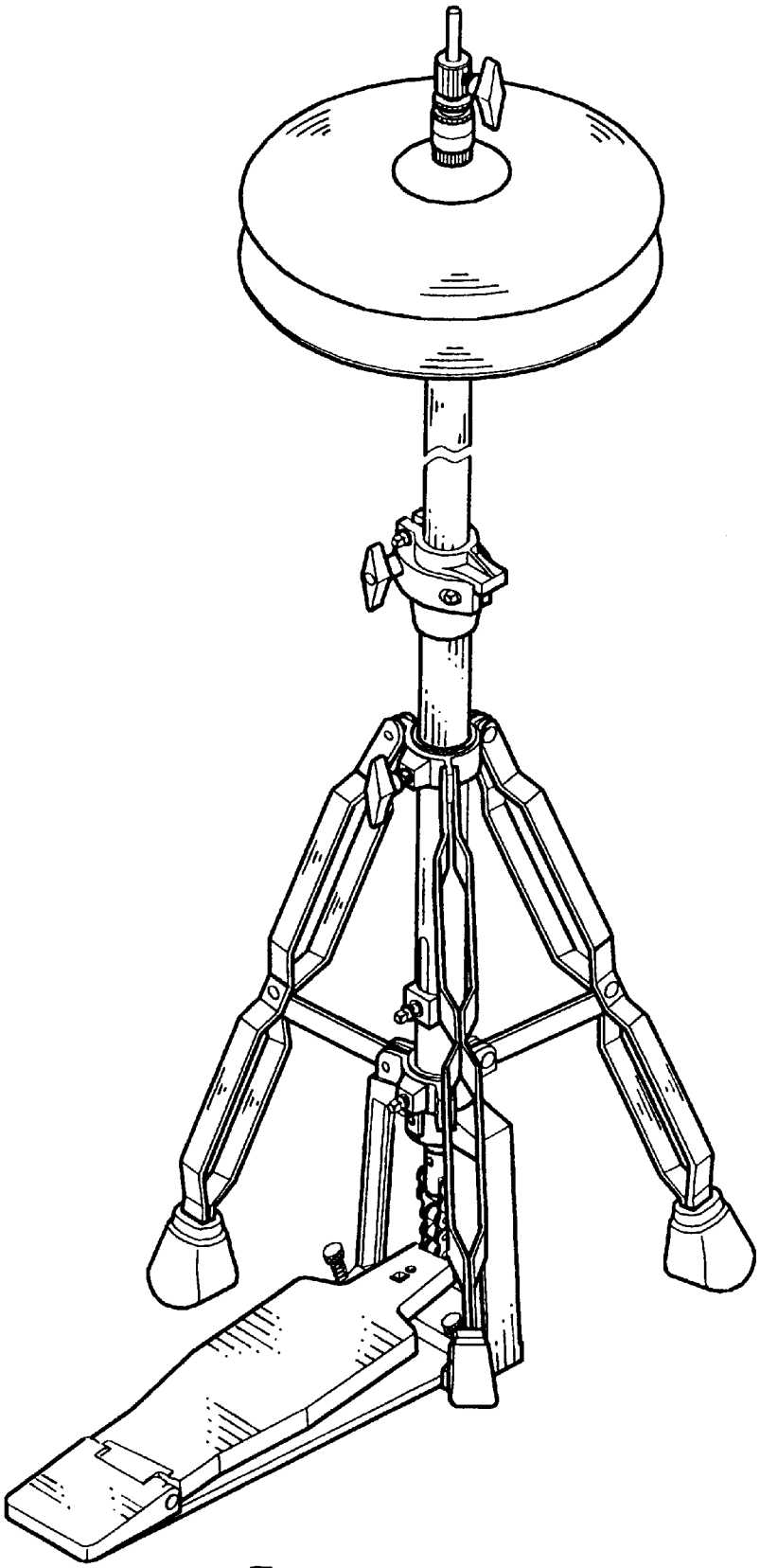
Fig.1 PRIOR ART
FIG. 1 is an elevational view of a hi-hat cymbal according to the prior art.
Figure 2:
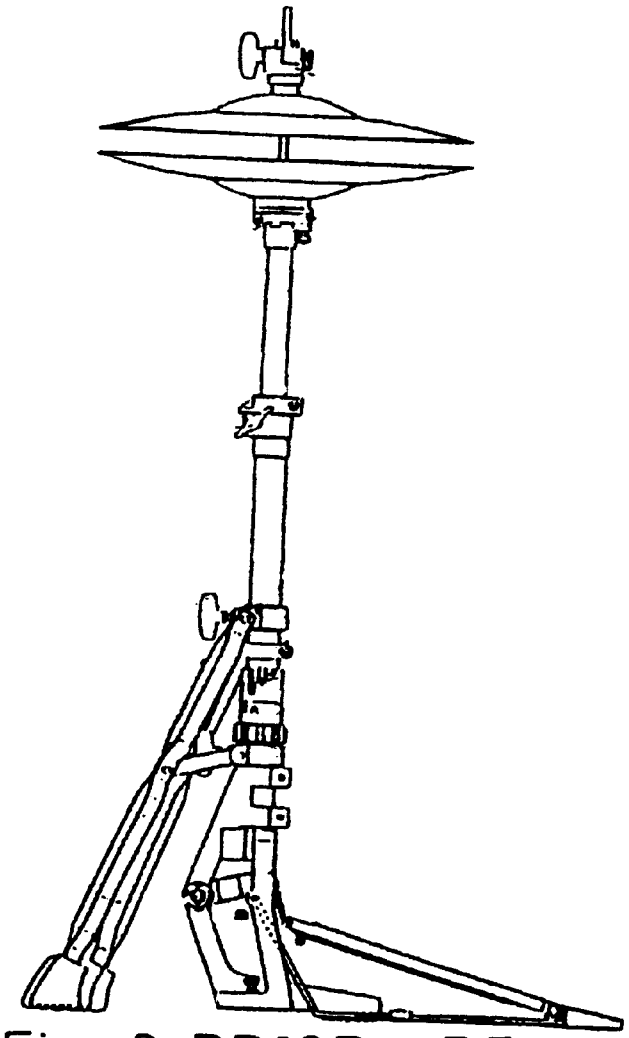
Fig. 2 PRIOR ART
FIG. 2 is a side view of another structure of hi-hat cymbal according to the prior art.
Figure 3:
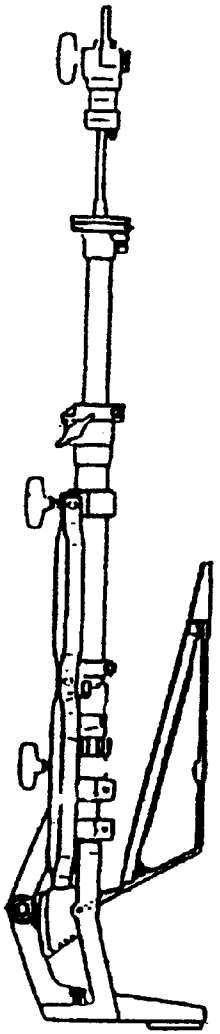
Fig. 3 PRIOR ART
FIG. 3 is similar to FIG. 2 but showing the foot pedal folded up.
Figure 4:
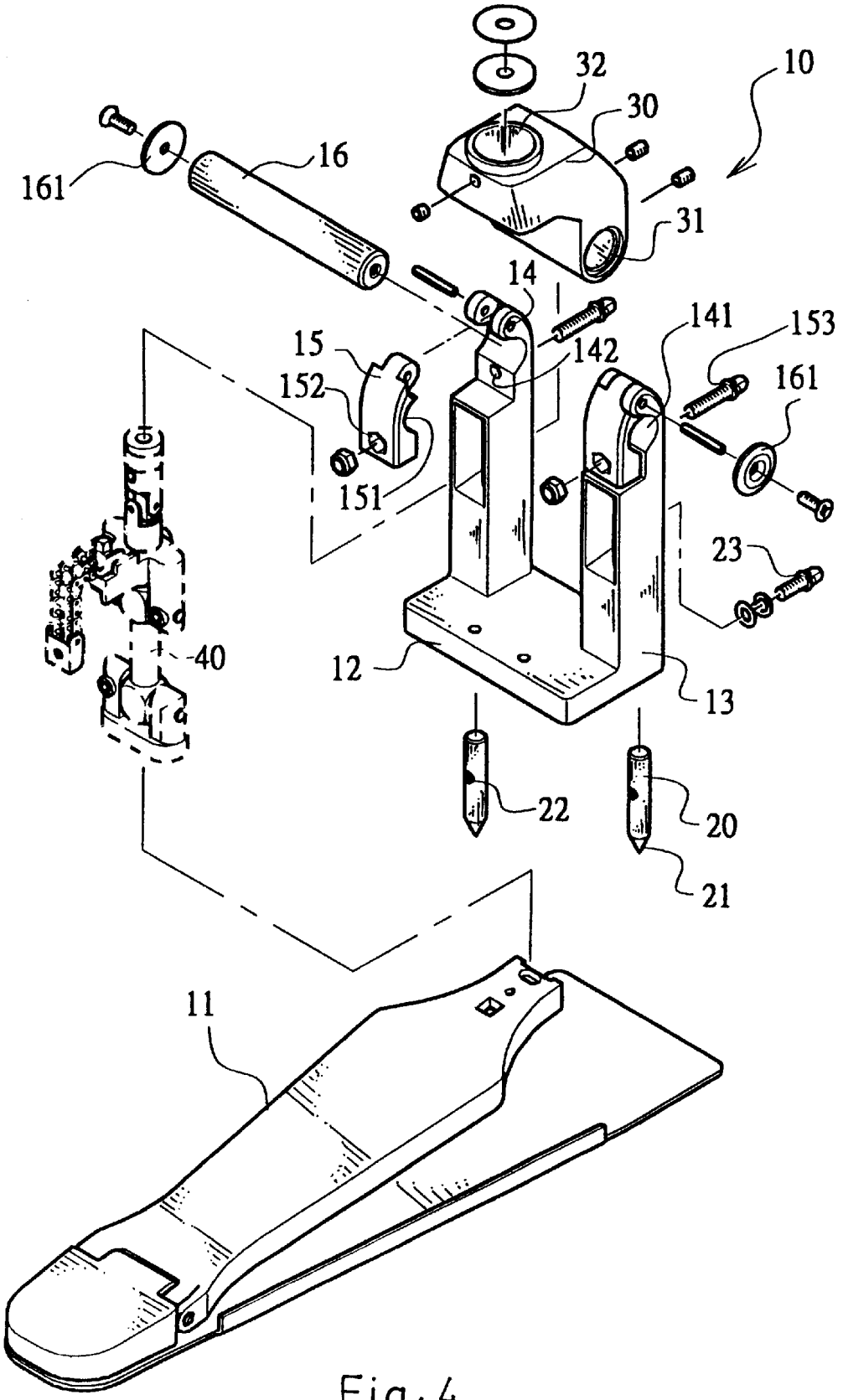
FIG. 4 is an exploded view of a foot pedal mechanism for a hi-hat cymbal according to the present invention.

Referring to FIGS. from 4 through 8, a folding collapsible foot pedal mechanism in accordance with the present invention is installed in a hi-hat cymbal comprised of a folding collapsible stand 42, a hollow shaft 41 supported on the stand 42, a center rod (not shown) mounted in the shaft 41, a stand control lock 43, an elevation control lock 44, and an upper cymbal control lock 45. The folding collapsible foot pedal mechanism comprises a pedal holder assembly 10, a foot pedal 11 fastened to the pedal holder assembly 10, a linking mechanism 40 coupled between the free end of the foot pedal 11 and the bottom end of the center rod in the shaft 41.

The pedal holder assembly 10 comprises a U-shaped holder base 12, two clamping plates 15, two anchoring rods 20, a transverse rod 16, and a coupling head 30. The holder base 12 comprises two parallel posts 13, two bottom blind holes 131 respectively and axially extended into the posts 13, two elongated, stepped sliding slots 132 respectively formed on the posts 13 at a back side and perpendicularly extended from the bottom blind holes 131, two pairs of parallel lugs 14 respectively formed on the posts 13 at the top, two horizontal through holes 142 respectively formed on the posts 13 and spaced between the sliding slots 132 and the lugs 14, and two transversely extended U-grooves 141 respectively formed on the posts 13 at a front side between the lugs 14 and the horizontal through holes 142. The clamping plates 15 each have a top end respectively pivoted to the lugs 14 at the posts 13, a bottom end formed with a through hole 152, which is connected to the horizontal through hole 142 on one post 13 by a screw bolt 153, and a transversely extended U-groove 151 disposed facing the transversely extended U-groove 141 on one post 13. The transverse rod 16 is mounted in the U-grooves 141 on the posts 13 and the U-grooves 151 on the clamping plates 15. After installation of the transverse rod 16, two end stops 161 are respectively fastened to two distal ends of the transverse rod 16 to stop the transverse rod 16 from axial movement relative to the posts 13 and the clamping plates 15. The anchoring rods 20 are respectively inserted into the bottom blind holes 131, each having a pointed bottom end 21 disposed outside the holder base 12, and a transversely extended screw hole 22. Two lock screws 23 are respectively mounted in the sliding slots 132 and threaded into the screw holes 22 on the anchoring rods 20 to fix the anchoring rods 20 to the bottom blind holes 131 at the desired elevation. The coupling head 30 is an angled block coupled between the posts 13 and turned about the transverse rod 16, having a transverse through hole 31, which receives the transverse rod 16, and a vertical through hole 32, which receives the shaft 41.

Figure 5:
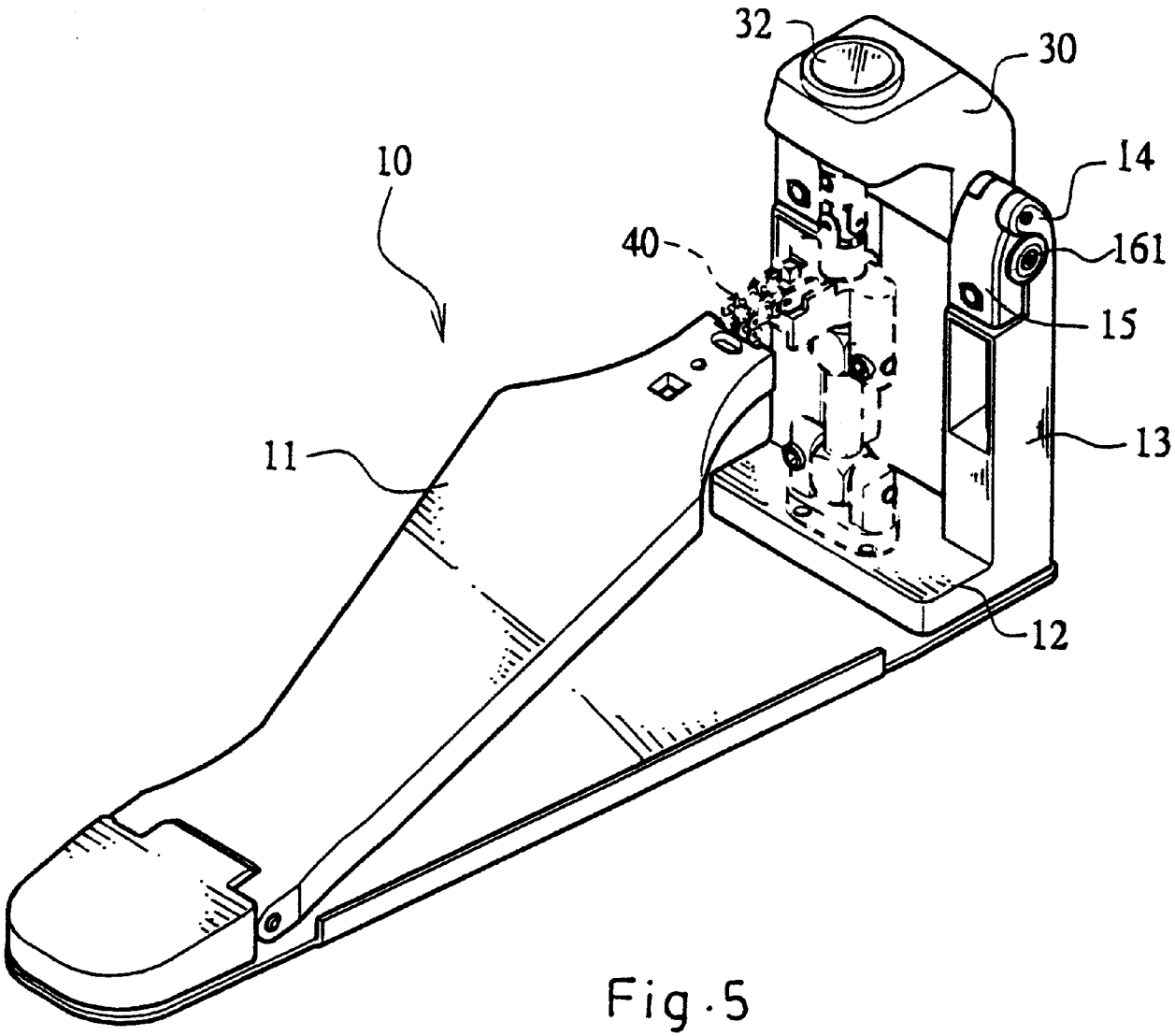
FIG. 5 is an assembly view of FIG. 5.
Figure 6:
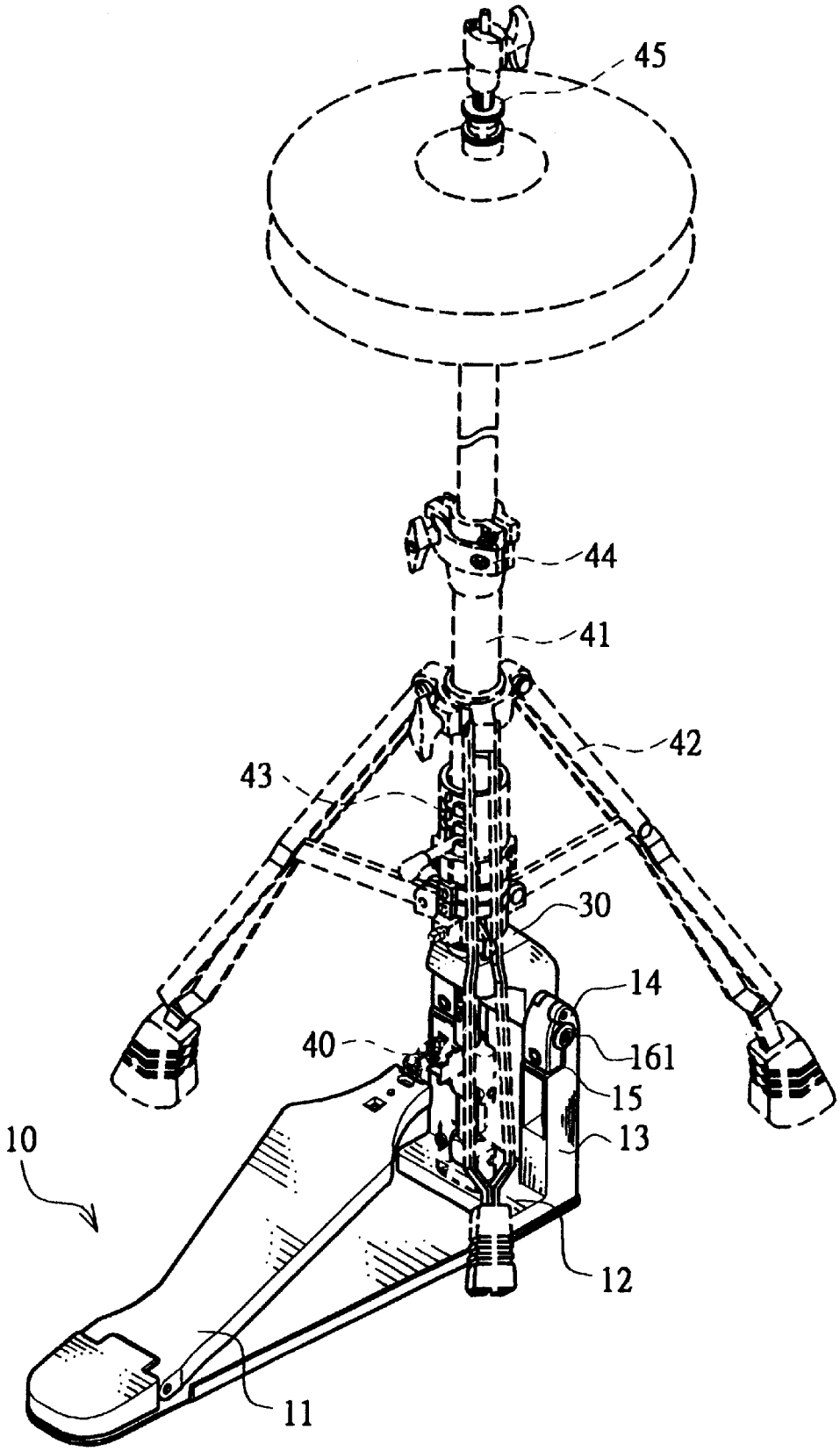
FIG. 6 shows the foot pedal mechanism installed in a hi-hat cymbal and set in the operative position according to the present invention.

When assembled, as shown in FIG. 5, the coupling head 30 is coupled to the transverse rod 16 between the posts 13. When installed in the hi-hat cymbal, as shown in FIG. 6, the coupling head 30 is coupled to the shaft 41, and the foot pedal 11 is coupled to the center rod in the shaft 41 by the linking mechanism 40. When in use, the stand 42 is extended out to support the hi-hat cymbal stably on the floor, and the anchoring rods 20 are positioned on the (carpet) floor to stop the foot pedal mechanism from displacement. When not in use, the elevation control lock 44 and the upper cymbal control lock 45 are removed from the shaft 41, and then the stand 42 is collapsed and closely attached to the shaft 41, and then the screw bolts 153 are loosened to disengage the clamping plates 15 from the transverse rod 16, for enabling the foot pedal 11 to be turned with the holder base 12 and the coupling head 32 about the transverse rod 16 from the operative position shown in FIG. 6 to the collapsed position shown in FIG. 7. When collapsed, the foot pedal 11 is disposed in parallel to the shaft 41, and then the screw bolts 153 are fastened tight again to fix the foot pedal mechanism in the collapsed position. Because the foot pedal 11 is disposed in parallel to the shaft 41 after the foot pedal mechanism has been collapsed, less storage space is needed for receiving the collapsed hi-hat cymbal.

Figure 7:
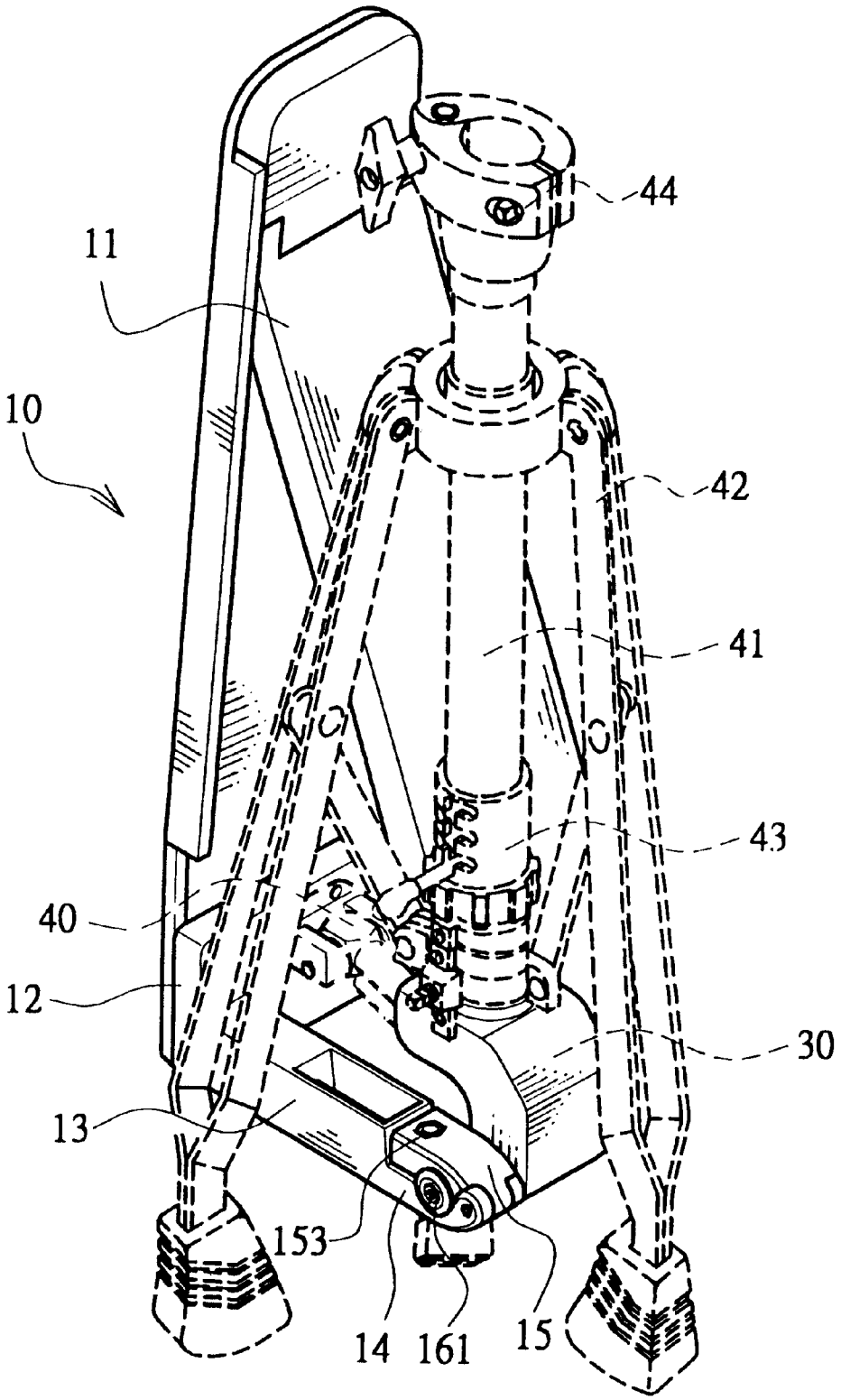
FIG. 7 shows the foot pedal mechanism collapsed according to the present invention.
Figure 8:
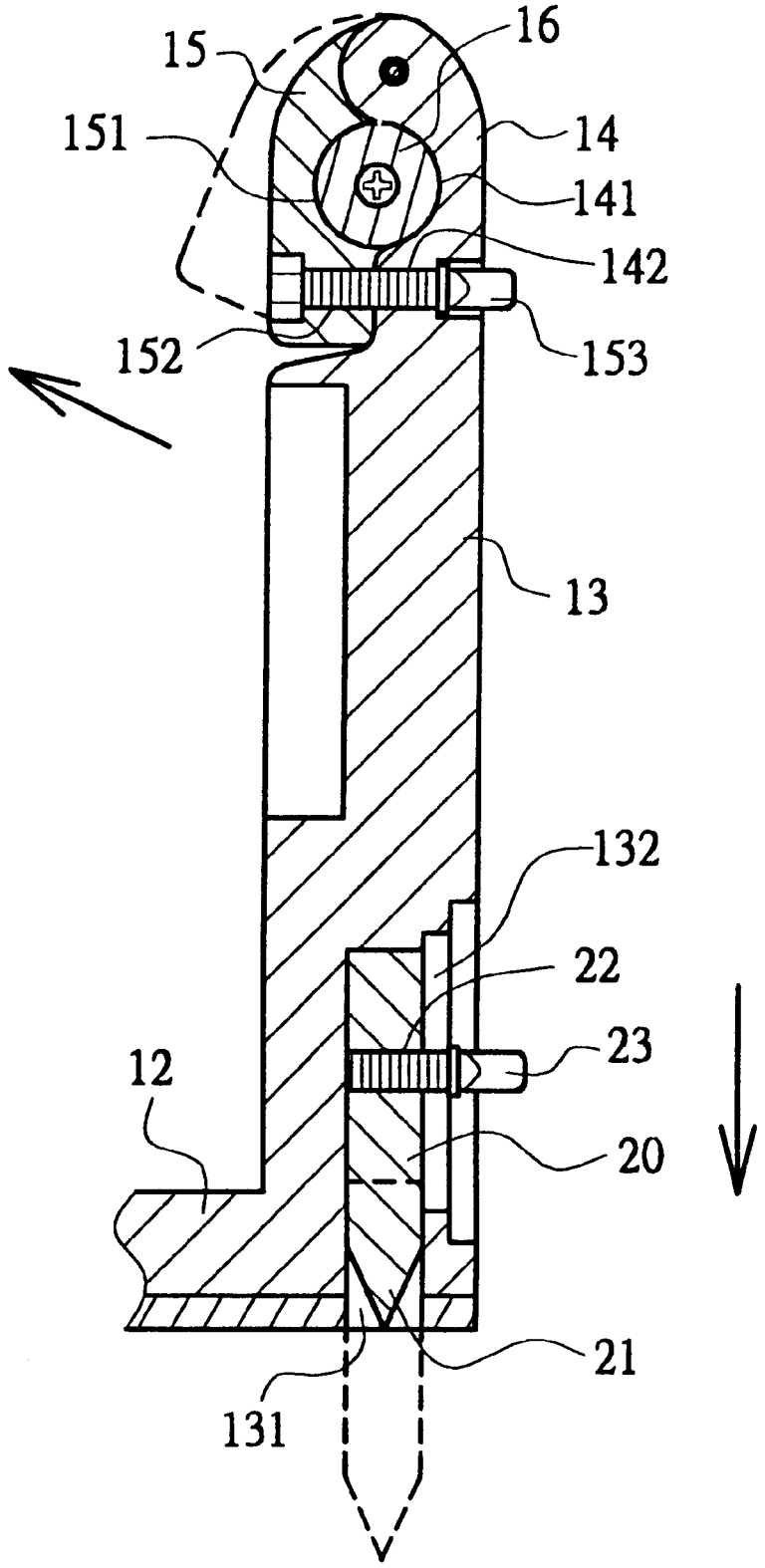
FIG. 8 is a schematic drawing showing the anchoring rods moved in the bottom blind holes on the holder base and the coupling head turned about the transverse rod according to the present invention.

When using the hi-hat cymbal, the stand 42 is extended out and positioned with the anchoring rods 20 on the carpet (floor), and then the center rod, the elevation control lock 44 and the upper cymbal control lock 45 are respectively installed in the shaft 41, and then the screw bolts 153 are loosened, and then the foot pedal 11 is turned outwards from the vertical (collapsed) position shown in FIG. 7 to the horizontal (operative) position shown in FIG. 6. By means of adjusting the elevation of the anchoring rods 20 in the bottom blind holes 131, the holder base 12 and the foot pedal 11 are positioned on the carpet (floor) positively in balance.

What the invention claimed is:

1. A folding collapsible foot pedal mechanism installed in a hi-hat cymbal comprised of a folding collapsible stand, a hollow shaft supported on said stand, a center rod mounted in said shaft, a stand control lock, an elevation control lock, and an upper cymbal control lock, the foot pedal mechanism comprising a pedal holder assembly, a foot pedal fixedly fastened to said pedal holder assembly, and a linking mechanism coupled between said foot pedal and a bottom end of said center rod, wherein said pedal holder assembly comprises:

a U-shaped holder base, said holder base comprising two parallel posts;

a transverse rod connected between said posts;

two clamping plates respectively fastened to said posts to fix said transverse rod in position; and an angled coupling head turned about said transverse rod, said coupling head comprising a transverse through hole, which receives said transverse rod, and a vertical through hole, which receives said shaft.

2. The folding collapsible foot pedal mechanism of claim 1 wherein said holder base comprises two pairs of parallel lugs respectively formed on said posts at a top side, two horizontal through holes respectively formed on said posts below said lugs, and two transversely extended U-grooves respectively formed on said posts at a front side between said lugs and said horizontal through holes; said clamping plates each have a top end respectively pivoted to said lugs at said posts, a bottom end, a through hole formed on said bottom end and fastened to the horizontal through hole on the corresponding post by a screw bolt, and a transversely extended U-groove disposed facing the transversely extended U-groove on the corresponding post for receiving one end of said transverse rod.

3. The folding collapsible foot pedal mechanism of claim 1 further comprising two end stops respectively fastened to two distal ends of said transverse rod to stop said transverse rod from axial movement relative to said posts.

* * * * *